US007198461B2

(12) United States Patent
Burgmeier et al.

(10) Patent No.: US 7,198,461 B2
(45) Date of Patent: Apr. 3, 2007

(54) APPARATUS FOR ADJUSTING STATOR VANES

(75) Inventors: Berthold Burgmeier, Thalmassing (DE); Georg Zotz, Haimhausen (DE)

(73) Assignee: MTU Aero Engines GmbH, Munich (DE)

( * ) Notice: Subject to any disclaimer, the term of this patent is extended or adjusted under 35 U.S.C. 154(b) by 134 days.

(21) Appl. No.: 10/981,747

(22) Filed: Nov. 5, 2004

(65) Prior Publication Data

US 2005/0271502 A1 Dec. 8, 2005

(30) Foreign Application Priority Data

Nov. 8, 2003 (DE) ..... 103 52 099

(51) Int. Cl.
*F01D 17/16* (2006.01)

(52) U.S. Cl. ..... 415/160

(58) Field of Classification Search ..... 415/160, 415/162

See application file for complete search history.

(56) References Cited

U.S. PATENT DOCUMENTS 4,652,208 A * 3/1987 Tameo ..... 415/162
5,492,446 A * 2/1996 Hawkins et al. ..... 415/160
6,019,574 A * 2/2000 DiBella ..... 415/160

FOREIGN PATENT DOCUMENTS

DE 39 13 102 C1 5/1990
DE 41 02 188 A1 8/1992

* cited by examiner

*Primary Examiner*—Ninh H. Nguyen
(74) *Attorney, Agent, or Firm*—Crowell & Moring LLP

(57) ABSTRACT

A device for the adjustment of stator vanes of a turbo engine includes an adjusting ring and an adjusting lever. The adjusting lever includes a first end, and a second end having an opening. The first end of the adjusting lever is connected to the adjusting ring. The device also includes an end of a shank of the stator vane, and the end of a shank of the stator vane enters into the opening of the second end of the adjusting lever to connect the second end of the adjusting lever to the end of the shank of the stator vane. The adjusting lever swivelingly connects the stator vane to the adjusting ring outside of the housing of the turbo engine. The device further includes a projection on the end of the shank, and the projection projects past the rim of the opening when the stator vane is in an installed position.

16 Claims, 4 Drawing Sheets

APPARATUS FOR ADJUSTING STATOR VANES

BACKGROUND AND SUMMARY OF THE INVENTION

The invention relates to an apparatus for adjusting stator vanes of a turbo drive mechanism, in particular, especially a gas turbine.

Gas turbines include several units, such as a fan, a fuel chamber, preferably compressors as well as turbines. The component units of a gas turbine are surrounded by a fixed housing.

In a turbine as well as in a compressor of the gas turbine, fixed stator vanes are disposed, as well as rotating runner blades. The running blades are associated with at least one rotor and rotate with respect to the stator vanes and to the stationary housing. If the turbine or compressor has two or more stages, stator vanes and runner blades are arranged alternately one behind the other, while along the circumference of the rotor or housing a plurality of runner blades and stator vanes are disposed, which form so-called stator vane rings and runner blade rings.

The stationary stator vanes can be adjustable or rotatable about an axis. DE 39 13 102 C1 discloses an apparatus for the adjustment of stator vanes in which stator vanes of a single stator vane ring are connected by an adjusting lever outside of a housing of the turbo drive mechanism to an adjusting ring, while the adjusting lever or each adjusting lever engages the adjusting ring with a first end and with a second end lying opposite the first end of a shank of the particular runner blade.

Another apparatus for the adjustment of stator vanes is disclosed in DE 41 02 188 C2. DE 39 102 188 C1 shows a compressor and DE 41 02 188 C2 shows a turbine of a gas turbine engine with an apparatus for the adjustment of stator vanes.

An adjusting lever is affixed at a second end by a fastening screw to the shank of the particular stator vane. In the operation of the gas turbine it is possible due to great mechanical stresses for the fastening screw to break. In the devices known in the prior art, in the adjustment of stator vanes the problem exists that, if the fastening screw breaks, the bond between stator vane and the adjusting lever is interrupted by the adjusting blade coming entirely free of the stator vane. The stator vane can then assume any random angular position in its channel in the gas turbine. The entire gas turbine can be damaged in this manner.

Setting out from this situation the present invention is addressed to the problem of creating a novel device for the adjustment of stator vanes of a turbo engine, especially a gas turbine.

This problem is solved by a device of the present invention. According to the invention, an opening is created in the second end of the adjusting lever or every adjustable lever, and the end of the shank of the particular stator vane engages this opening. The end of the shank has a projection, and the projection protrudes over the margin of this opening when the blade is in the installed position. In case of breakage of the screw serving to affix an adjusting lever to a stator vane, the adjusting lever is prevented by the invention from completely separating from the stator vane. Accordingly it is assured by the invention that, even if this screw breaks the corresponding stator vane will maintain its angular position.

Preferably, when a particular stator vane is in the installed position, the opening associated with the second end of the adjusting lever is aligned with an opening associated with the shank of the particular stator vane such that a fastening screw passes through these openings. When the particular stator vane is in a position (wrong position) turned about 180° from the installed position, the opening associated with the second end of the adjusting lever is off-center from the opening associated with the shank. Any fastening of the adjusting lever to a stator vane in a wrong position is thereby prevented.

According to an advantageous improvement of the invention, the adjusting lever, or every adjusting lever, has an opening at the first end which, when the adjusting lever is in the installed position, is entered by a pin-like element for affixing the adjusting lever to the adjusting ring. When the particular stator vane is in the installed position, the opening associated with the first end of the stator vane is aligned with at least one opening associated with the adjusting ring, such that the pin-like element passes through these openings. When the particular stator vane is in a position (wrong position) turned about 180° away from the installed position, the opening associated with the first end of the adjusting lever is out of line with the openings associated with the stator ring. The adjusting lever is thus prevented from being fastened to a stator vane in a wrong position.

Other objects, advantages and novel features of the present invention will become apparent from the following detailed description of the invention when considered in conjunction with the accompanying drawings.

DETAILED DESCRIPTION OF THE DRAWINGS

Figure 1:
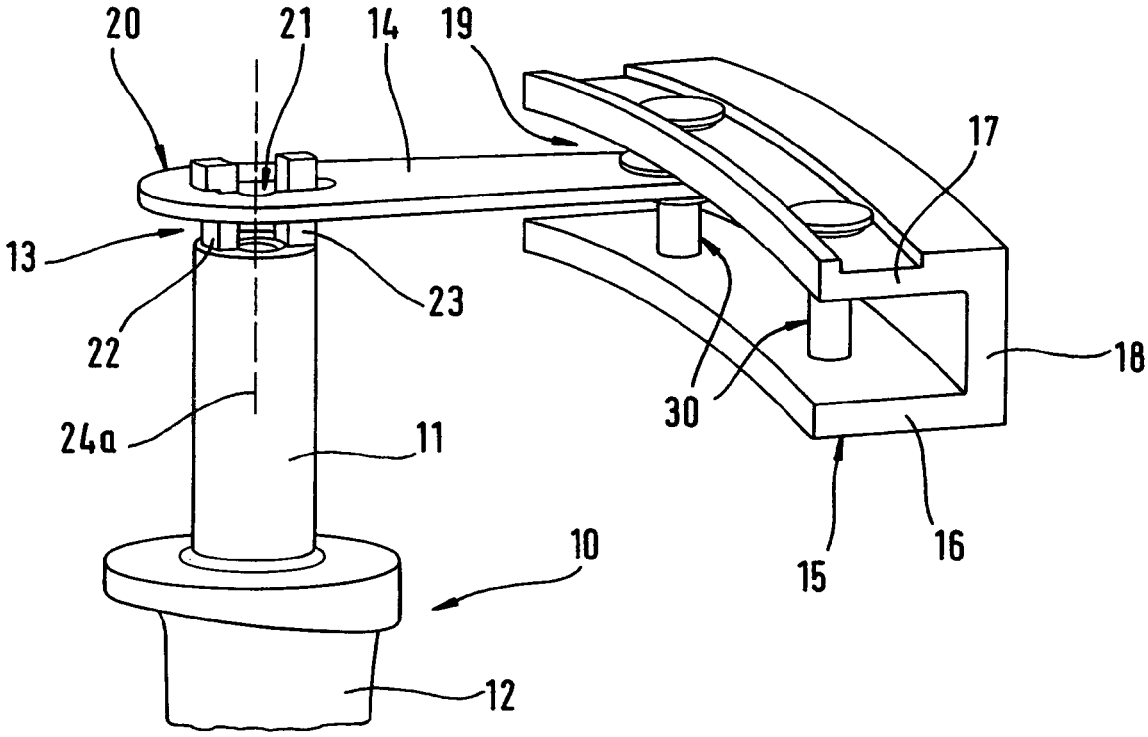
FIG. 1 is a section of a device according to the invention for the adjustment of stator vanes, with a stator vane in the installed position in a schematic, perspective side view.
Figure 2:
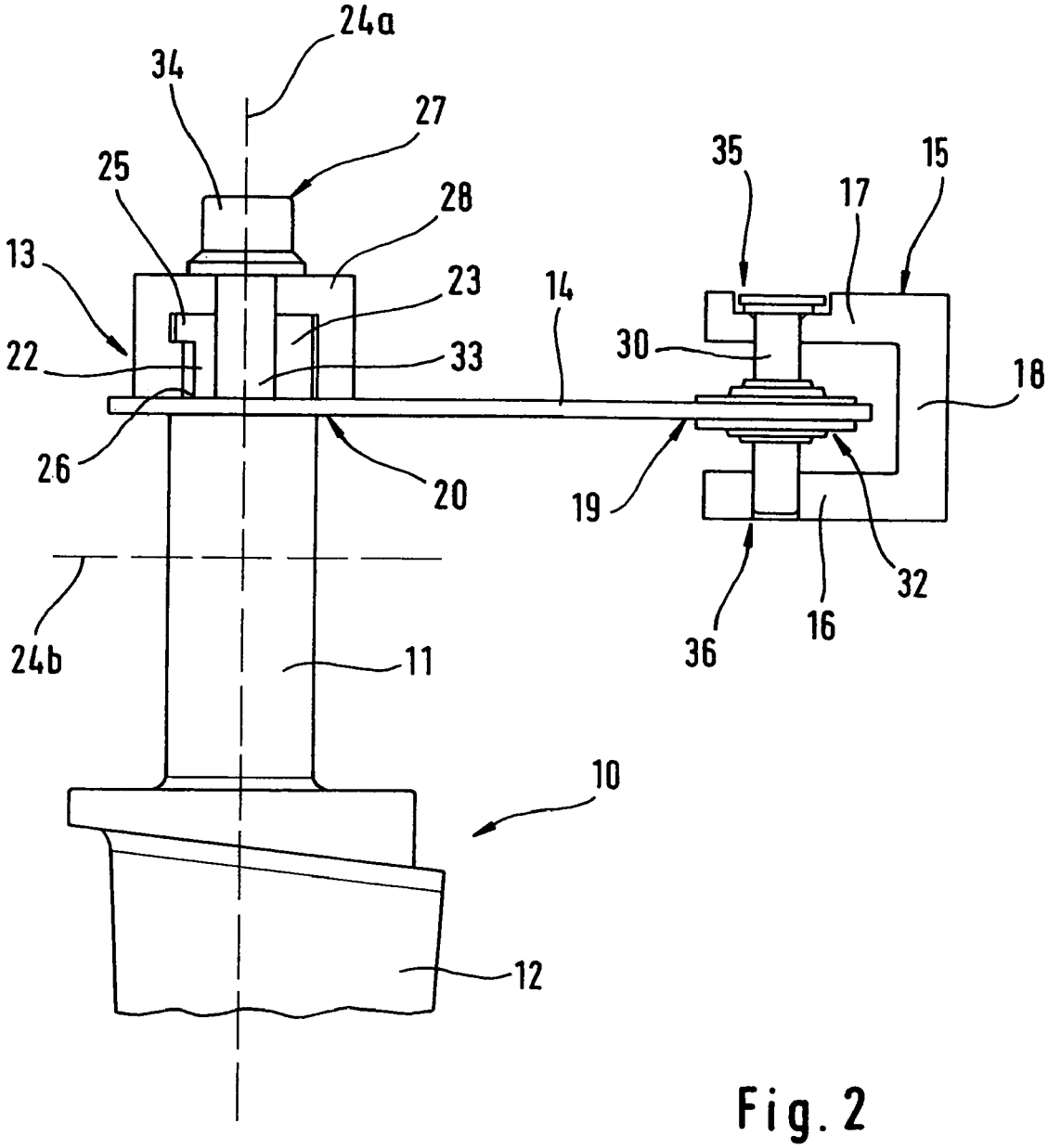
FIG. 2 shows the arrangement according to FIG. 1 in a schematic side view.
Figure 3:
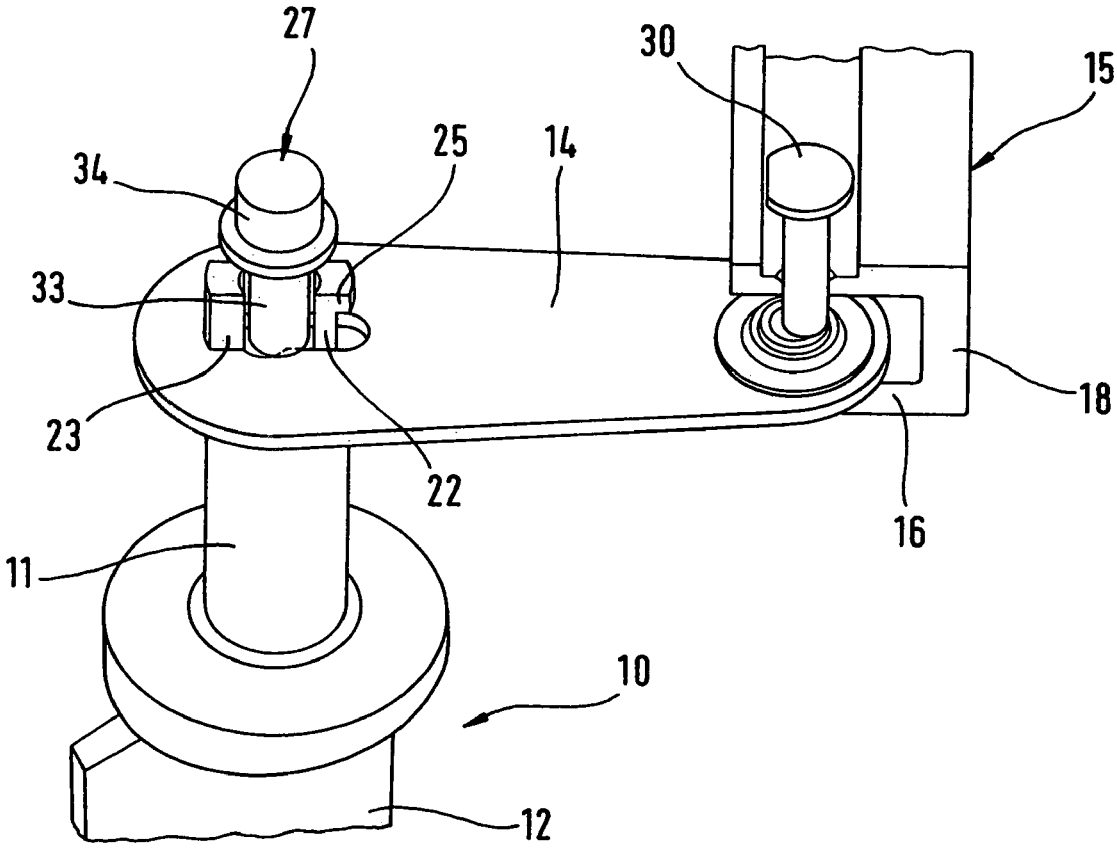
FIG. 3 shows a section of a device according to the invention for the adjustment of stator vanes showing a stator vane in an incorrect position in a schematic, perspective side elevation.
Figure 4:
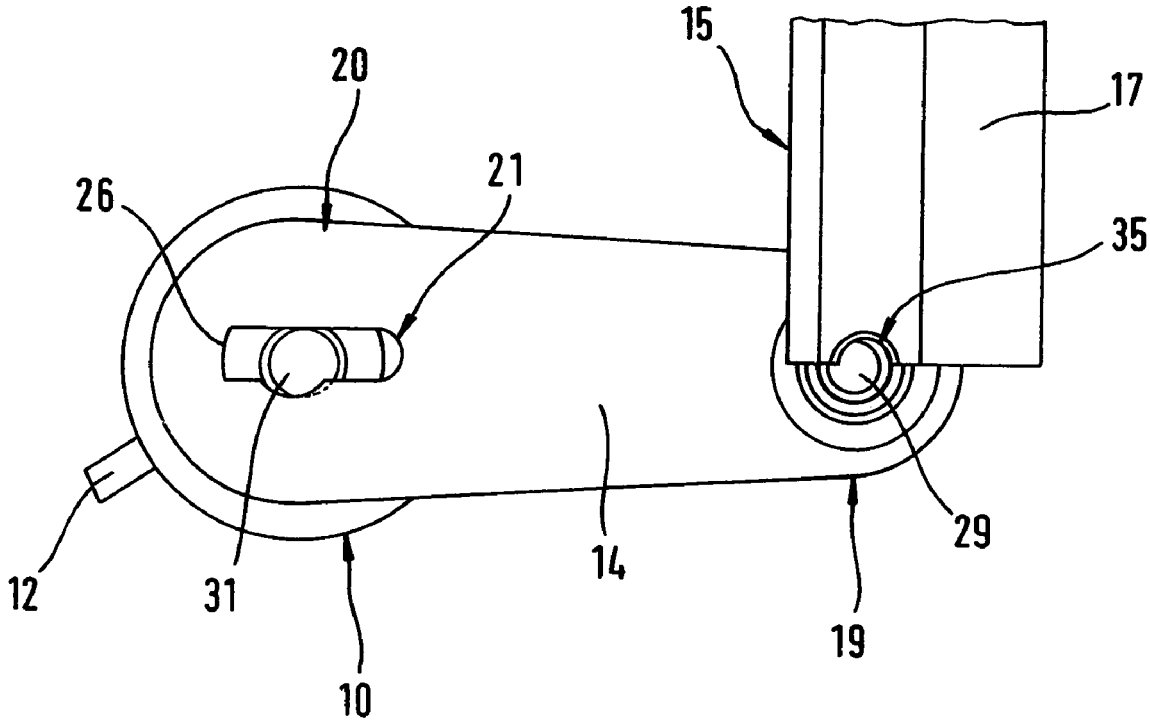
FIG. 4 shows the arrangement according to FIG. 3 in a schematic top plan view.

Certain preferred embodiments of the present invention are described in greater detail hereinbelow with reference to FIGS. 1 to 4. FIGS. 1 and 2 show a device of the present invention for adjusting stator vanes, with a stator vane in the installed position, and FIGS. 3 and 4 show the device of the invention with a stator vane in a wrong position.

FIGS. 1 and 2 show a section of a stator vane 10 of a stator vane ring. The stator vane 10 passes with its outer shank 11 through a housing, not shown, of a turbo engine, namely a gas turbine. The shank 11 adjoins a stator blade 12 of the stator vane 10. An adjusting lever 14 engages one outer end 13 of the shank 11 of the stator vane 10. The stator vane 10 is connected by the adjusting lever 14 to an adjusting ring 15. Note that all stator vanes 10 of a stator vane ring are connected each by an adjusting lever 14 to the adjusting ring 15. Thus it is assured that, when the adjusting ring 15 is turned with respect to the housing of the gas turbine, all stator vanes 10 of a stator vane ring are uniformly adjusted.

In the embodiment represented, the adjusting ring 15 is U-shaped in cross section. The adjusting ring 15 accordingly has two flanges 16 and 17 which are joined together by a rim 18. At one end 19 opposite the first end 20, the adjusting lever 14 engages the shank 11 of the stator vane 10.

An opening 21 is created in the second end 20 of the adjusting lever 14. The end 13 of the shank 11 of the stator vane 10 penetrates in the installed position into the opening 21 (see FIGS. 1 and 2). The end 13 of the shank 11 is formed of two stub-like elements 22, 23. The two stub-like elements 22 and 23 extend in the axial direction of the shank 11, this axial direction being indicated by line 24*a* in FIGS. 1 and 2. The stub-like elements 22 and 23 are spaced apart in the radial direction of the shank 11, this radial direction being visualized in FIG. 2 by the line 24*b*. The two stub-like elements 22 and 23 are differently made. A first stub-like element 22 has a projection 25. When the stator vane 10 is in the installed position, the projection 25 reaches past an edge 26 defining the cut-out 21. In the installed position of the stator vane 10, the adjusting lever 14 is affixed to the shank 11 of the stator vane 10 by a fastening screw 27, while a threaded shank 33 of the fastening screw 27 extends between the two stub-like elements 22 and 23, and a head 34 of the fastening screw 27 lies on a thrust cap 28. The above described configuration of the end 13 of the shank 11, to the end that a projection 25 is associated with a stub-like element 22 and reaches past the edge 26 defining the cut-out 21, the assurance is given that, in the event of breakage of the fastening screw 27, the adjusting lever 14 cannot come completely loose from the shank 11 of the stator vane 10. Instead, the projection 25 forms an abutment which holds the adjusting lever 14 in its position on the shank 11. This assures that, even in case the fastening screw 27 breaks, the adjusting lever will remain in active engagement with the stator vane 10.

In addition to the cut-out 21 near its second end 20, the adjusting lever 14 likewise has an opening 29 near the first end 19 (see FIG. 4). When the stator vane 10 is in the installed position, the first end 19 of the adjusting lever 14 is fastened by a pin-like element 30 to the adjusting ring 15. The pin-like element 30 runs approximately parallel to the rim 18 of the adjusting ring 15 and passes through openings 35 and 36 of the adjusting ring 15 in the area of the flanges 16 and 17. In the installed position the pin like element 30 passes through the openings 35 and 36 in the flanges 16 and 17 of the adjusting ring 15, as well as the opening 29 near the first end 19 of the adjusting lever 14.

The device of the invention for the adjustment of stator vanes of the turbo engine prevents not only the releasing of the adjusting lever 14 from the shank 11 of the vane 10 in the event of breakage of the fastening fastening screw 27, but also any installation of a vane 10 in the wrong position. As explained above, the device for the adjustment of vanes is positioned outside of any housing of the gas turbine, the blades 12 of the stator vanes reach inside of the housing of the gas turbine, and only the shank 11 of the stator vane 10 passes through the housing. When the adjusting lever 14 is fastened to the shank 11 of the stator vane and to the adjusting ring 15 it is accordingly impossible to see from the exterior whether the stator vane 10 is in the installed position. To avoid fastening the stator vane 10 to the device for adjusting the stator vanes in a wrong position, the first stub-like element 22 is of reduced thickness in the radial direction (line 24*b*) compared to the second stub-like element 23. Accordingly, if an installer should position the adjusting lever 14, with the cut-out 21 over the end 13 of shank 11 formed by the stub-like elements 22 and 23, in the wrong position relative to the shank 11 as well as adjusting ring 15, then the excentric position of the adjusting lever 14 shown in FIG. 4 would result. In this wrong position the opening 29 associated with the first end 19 of the adjusting lever 14 is off-center from the openings 35 and 36. On the other hand, in this wrong position, the opening 26 associated with the second end 20 of the adjusting lever 14 is off-center from an opening 31 configured as a threaded bore and associated with the shank 11, while the fastening screw 27 reaches with its threaded shank into the cut-out 31 when the stator vane 10 is in the installed position. Accordingly it is prevented that, when the stator vane 10 is in the wrong position, the pin-like element 30 can be introduced into the opening 29 in the area of the first end 19 of the adjusting lever 14, and the fastening screw 27 can be introduced into the opening 31 in the area of the shank 11. This excentricity described above, between the various openings, is caused by the different radial thicknesses of the arms 22 and 23. Accordingly, a stator vane 10 is prevented from being installed or fastened in the wrong position to the device according to the invention for the adjustment of stator vanes.

With the device according to the invention for the adjustment of stator vanes, if the fastening screw 27 serving to fasten the adjusting lever 14 to the stator vanes 10 breaks, the adjusting lever 14 is prevented from coming loose from shank 11 of the stator vane 10. Furthermore, by means of the device of the invention, any assembly with a stator vane 10 in the wrong position is prevented. Therefore, damages which might result from faulty installation of the stator vane 10, or in the event of uncontrolled movement of the stator vanes 10 within the passages of the gas turbine, are reliably prevented.

The adjusting lever 14 is fastened at its first end 19 to the pin-like element 30 through a bearing 32. The bearing 32 permits a displacement of the first end 19 of the adjusting lever 14 relative to the pin-like element 30. The bearing 32 is in the form of a spherical bearing. An inner ring of the spherical bearing is associated with the pin-like element 30, and an external ring of the spherical bearing is associated with the first end 19 of the adjusting lever 14. The outer ring of the spherical bearing is crimped directly onto the first end 19 of the lever 14.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A device for the adjustment of stator vanes of a turbo engine having a housing, comprising:

an adjusting ring;

an adjusting lever including:

a first end, and a second end having an opening, wherein the first end of the adjusting lever is connected to the adjusting ring;

an end of a shank of the stator vane, wherein the end of the shank of the stator vane enters into the opening of the second end of the adjusting lever to connect the second end of the adjusting lever to the end of the shank of the stator vane, whereby the adjusting lever swivelingly connects the stator vane to the adjusting ring outside of the housing of the turbo engine; and a projection on the end of the shank, wherein the projection extends radially from an axial direction of the shank, and wherein the projection projects past the rim of the opening when the stator vane is in an installed position.

2. The device according to claim 1, wherein the end of the shank of the stator vane includes first and second stub-like elements extending in the axial direction of the shank, wherein the projection is placed on the first stub-like element, and wherein the first stub-like element has in the radial direction of the shank a thickness that is less than the thickness of the second stub-like element.

3. The device according to claim 2, wherein the first end of the adjusting lever includes an opening into which a pin-like element extends when the stator vane is in the installed position in order to affix the adjusting lever to the adjusting ring.

4. The device according claim 3, wherein the adjusting ring has at least one opening, and wherein when the stator vane is in the installed position the opening of the first end of the adjusting lever is aligned with the at least one opening of the adjusting ring such that the pin-like element extends through these openings.

5. The device according to claim 4, wherein, with the stator vane in a position that is about 180° from the installed position, the opening of the first end of the adjusting lever is off-center from the at least one opening of the adjusting ring.

6. The device according to claim 5, wherein the end of the shank of the stator vane includes an opening, and wherein, in the installed position of the stator vane, the opening of the second end of the adjusting lever is aligned with the opening of the end of the shank such that a fastening screw can extend into the openings.

7. The device according to claim 6, wherein, with the stator vane in a position that is about 180° from the installed position, the opening of the second end of the adjusting lever is off-center from the opening of the end of the shank.

8. The device according to claim 7, wherein the first end of the adjusting lever is journaled on the pin-like element such that the first end of the adjusting lever is adjustable with respect to the pin-like element.

9. The device according to claim 8, wherein the first end of the adjusting lever is journaled on the pin-like element through a spherical bearing, an internal ring of the spherical bearing being associated with the pin-like element and an external ring of the spherical bearing being associated with the first end of the adjusting lever.

10. The device according to claim 1, wherein the first end of the adjusting lever includes an opening into which a pin-like element extends when the stator vane is in the installed position in order to affix the adjusting lever to the adjusting ring.

11. The device according to claim 10, wherein the adjusting ring has at least one opening, and wherein when the stator vane is in the installed position the opening of the first end of the adjusting lever is aligned with the at least one opening of the adjusting ring such that the pin-like element extends through these openings.

12. The device according to claim 11, wherein, with the stator vane in a position that is about 180° from the installed position, the opening of the first end of the adjusting lever is off-center from the at least one opening of the adjusting ring.

13. The device according to claim 1, wherein the end of the shank of the stator vane includes an opening, and wherein, in the installed position of the stator vane, the opening of the second end of the adjusting lever is aligned with the opening of the end of the shank such that a fastening screw can extend into the openings.

14. The device according to claim 13, wherein, with the stator vane in a position that is about 180° from the installed position, the opening of the second end of the adjusting lever is off-center from the opening of the end of the shank.

15. The device according to claim 1, wherein the first end of the adjusting lever is journaled on a pin-like element such that the first end of the adjusting lever is adjustable with respect to the pin-like element.

16. The device according to claim 15, wherein the first end of the adjusting lever is journaled on the pin-like element through a spherical bearing, an internal ring of the spherical bearing being associated with the pin-like element and an external ring of the spherical bearing being associated with the first end of the adjusting lever.

* * * * *